US007728781B2

(12) United States Patent
Youn

(10) Patent No.: US 7,728,781 B2
(45) Date of Patent: Jun. 1, 2010

(54) TRANSMISSION LINE NOTCH FILTER

(75) Inventor: Tai Won Youn, Albuquerque, NM (US)

(73) Assignee: TC License Ltd., Hummelstown, PA (US)

( * ) Notice: Subject to any disclaimer, the term of this patent is extended or adjusted under 35 U.S.C. 154(b) by 323 days.

(21) Appl. No.: 12/043,661

(22) Filed: Mar. 6, 2008

(65) Prior Publication Data

US 2009/0224989 A1 Sep. 10, 2009

(51) Int. Cl.
*H01Q 1/36* (2006.01)
*H01Q 1/50* (2006.01)

(52) U.S. Cl. ..... 343/795; 343/860; 343/861; 343/850

(58) Field of Classification Search ..... None
See application file for complete search history.

(56) References Cited

U.S. PATENT DOCUMENTS

| | | | | |
|---|---|---|---|---|
| 4,206,428 | A | 6/1980 | Kaegebein | |
| 4,816,839 | A | 3/1989 | Landt | |
| 5,949,309 | A | 9/1999 | Correa | |
| 7,116,960 | B2 * | 10/2006 | Kwon | 455/285 |
| 7,583,231 | B2 * | 9/2009 | Kwon et al. | 343/749 |
| 7,589,690 | B1 * | 9/2009 | Hertel | 343/795 |
| 7,595,766 | B2 * | 9/2009 | Rofougaran | 343/795 |
| 2005/0248418 | A1 * | 11/2005 | Govind et al. | 331/179 |
| 2006/0284705 | A1 | 12/2006 | Kamgaing | |
| 2007/0035462 | A1 * | 2/2007 | Hertel | 343/795 |
| 2008/0180346 | A1 * | 7/2008 | Rofougaran | 343/861 |

OTHER PUBLICATIONS

Aglient Technologies, Inc., Designing Detectors for RF/ID Tags, www.semiconductor.agilent.com, 5966-0786E (Nov. 1999).
Aglient Technologies, Inc., Designing the Virtual Battery, www.semiconductor.agilent.com, 5966-0785E (Nov. 1999).
Aglient Technologies, Inc., Low Cost Surface Mount Power Limiters, www.semiconductor.agilent.com, 5091-4931E (Nov. 1999).
Aglient Technologies, Inc., Schottky Diode Voltage Doubler, www.semiconductor.agilent.com, 5964-4236E (Nov. 1999).

(Continued)

*Primary Examiner*—Trinh V Dinh
(74) *Attorney, Agent, or Firm*—Caesar, Rivise, Bernstein, Cohen & Pokotilow, Ltd.

(57) ABSTRACT

A transponder includes a notch filter to suppress the 1300 MHz at minimal product cost increase. The notch filter utilizes a printed transmission line length adjusted to a correct length. This notch filter will connect to the antenna matching circuit at a junction between the antenna and an ASIC as a shunt component with high impedance (e.g., greater than 500 Ohms) at 915 MHz and low impedance (e.g., less than 10 Ohms) at 1300 MHz. Since the operating impedance of the junction is about 200 ohms, the 915 MHz signal from the antenna will feed the ASIC without any attenuation with a high shunt impedance component, while the 1300 MHz signal will be attenuated significantly by a low shunt impedance component. The transponder is applicable for all types of RFID tags (e.g., passive, semi-passive, active, read only, read-write, read first, tag-talk first) and is well suited for tags operating at radio frequencies, including microwave frequencies (e.g., 902 MHz to 928 MHz) in the U.S.

20 Claims, 4 Drawing Sheets

OTHER PUBLICATIONS

Matthaei, et al., Microwave Filters, Impedance-Matching Networks, and Coupling Structures, Artech Books, Dedham, MA, pp. 614-626, Microwave Filters, Impedance-Matching Networks, and Coupling Structures, ISBN 978-0-89006-099-5, Copyright 1980.

Microwave Committee Components Service, Notch Filters for AO-40 Mode L/S, www.g3wdg.free-online.co.uk/notch.htm (Nov. 2007).

* cited by examiner

TRANSMISSION LINE NOTCH FILTER

BACKGROUND OF THE INVENTION

1. Field of the Invention

This invention relates to an antenna system in a transponder for modulating signals from a reader and for reflecting the modulated signals back to the reader to pass information from the transponder to the reader.

2. Description of Related Art

RFID (radio frequency identification) tags have been used for highway toll collections, tracking railroad freight cars, parking access, and inventory controls. These RFID tags typically consist of an antenna, an antenna impedance matching circuit, and an Application Specific Integrated Circuit (ASIC). The antenna receives the RF signals from the interrogator (reader), and feeds the signal to the ASIC through the antenna matching circuit between the antenna and ASIC. ASIC has hardware and software circuits to handle the RF signals and the signal processing respectively.

In the early 1990s, passive Radio Frequency Identification (RFID) systems were selected by the Association of American Railroads (AAR) for continent-wide electronic identification of railroad rolling stock. Such systems were designed for the harsh rail environment and exhaustively tested by the AAR. Performance, electronic, microwave, and mechanical specifications were selected so that the RFID equipment would not only survive the harsh rail environment, but also have a very long life. Passive tags (i.e. with no battery and using modulated backscatter technology) were installed, two on each rail car, beginning about 1991. The tags were to operate at an electric field strength of 2 V/m rms or higher in the frequency band of 902 MHz to 928 MHz. The tags were to survive incident electric field strength of 50 V/m of continuous exposure for 60 seconds for a radio signal of any frequency including in the design band of 902 MHz to 928 MHz. Mechanical requirements for solar radiation, impact, solvents, etc. were also specified and the tags were designed that would meet the requirements.

Early in 1992, reports of tag failures began to surface. The failures were not wide spread, and appeared to be higher on the west coast. Initially, the damage was thought to be caused by electrostatic discharge (ESD) damage during tag programming. Tags were programmed through physical contact, placing the tag in a programming head of a programmer. Efforts to reduce ESD using industry-approve techniques (wrist straps at programming stations, etc.) failed to reduce the problem.

Next, based on information that the majority of initial tag failures were observed on the west coast, a plan was developed to try and identify where and how the tags were damaged. The damage was known to look like ESD, affecting the sensitive diodes on the tag antenna used to convert RF (radio frequency) signals to DC (direct current) power. No physical damage was observed to the case or circuit board of the tag.

The source of the damage was determined to be a high power (megawatts) air-traffic control radar dish with a high gain antenna (about 40 dB) operating near 1300 MHz. The radar was pulsed, and the dish rotated slowly, scanning for aircraft. The radar was placed close to a railroad and a highway ran there between. When present, large trucks on the highway could protect rail cars from the radar by blocking the line of sight between the radar dish and rail cars. This explains why only a small percentage of tags on the side of the train facing the radar dish were damaged; even though electric field strengths in the area could be enhanced by a phenomenon known as multipath. An engineering investigation and studies indicated that tags passing near the radar dish would need to survive in a pulsed microwave field of 1,500 V/m at 1300 MHz, which is slightly above the targeted 902 MHz to 928 MHz frequency band of the tags.

In the fall of 1992, specifications were set by the AAR and hardening of the tag began. The new specifications (listed in the AAR S918, page K88) were 1,500 V/m pulsed and 100 V/m CW (an increase from the earlier number of 50 V/m). In particular, RFID tags for the railroad application operating at 915 MHz band are required to survive from the radar signal of 1500 V/m field strength at 1,300 MHz. The percentage separation between the operating frequency and the radar signal is only 28% which is too close to filter out a 1300 MHz signal at a negligible cost.

One technical solution that met the requirements used a microwave PIN limited diode between the output of the tag antenna and the input of the matching section such as disclosed in U.S. Pat. No. 4,816,839 to Jeremy Landt. The industry has used a limiter diode and subsequently a discrete component band pass filter to protect the 915 MHz railroad RFID tags from the radar signal of 1500 V/m field strength at 1,300 MHz. Low (i.e. 5 ohms) and high (i.e. 100 ohms) impedance transmission lines are used for the matching circuit between the limiter diode and the voltage doubler, which is a front-end RF circuit of the ASIC. The characteristics of this matching circuit changes with frequency. The discrete component band-pass filter works for the frequency range below the self-resonant frequencies. Therefore both the limiter and discrete filters protect the RFID tags from the high power source within a limited frequency range rather than the entire frequency range.

The effectiveness of the technical solution and the design of the tags are proven by over 15 years of operation of these tags in the harsh rail environment without problems, however, the implementations have added significantly to the cost of the tag. In particular, the use of limiter diodes and discrete band filters adds a considerable cost increase of $0.50 and $0.20, respectively per tag, which is significant considering the large product volume. There has been a long-standing need in the industry to provide protection from high power microwaves, such as radar discussed above, at reduced costs for expansion of the transponders in the market.

All references cited herein are incorporated herein by reference in their entireties.

BRIEF SUMMARY OF THE INVENTION

This invention provides a transponder which overcomes the above difficulties. This new transponder includes a notch filter to suppress the 1300 MHz at minimal product cost increase. The notch filter utilizes a printed transmission line length adjusted to a correct length. This notch filter will connect to the antenna matching circuit as a shunt component with high impedance (e.g., greater than 500 Ohms) at a frequency between about 902 MHz to 928 MHz and low impedance (e.g., less than 10 Ohms) at 1300 MHz. In particular, the notch filter is coupled between the antenna and the circuit including the matching circuit and the ASIC.

The invention includes a transponder having a microwave operating frequency. The transponder includes a dielectric member having a first surface and a second surface opposite the first surface, an antenna disposed on the first surface of the dielectric member, a matching circuit conductively coupled to the antenna, an integrated circuit conductively coupled to both the antenna and to the matching circuit, and a notch filter connected to the matching circuit at a junction between the antenna and the integrated circuit. The notch filter is a shunt component with a high impedance of at least about 500 ohms at the operating frequency of the transponder and a low impedance of at most about 10 ohms at a stop-band frequency of the transponder different than the operating frequency. The notch filter has a transmission line length determined by both the operating frequency and the stop-band frequency of the transponder.

The invention includes a method of making a transponder having a microwave operating frequency. The method includes determining a transmission line length for a notch filter to operate as a shunt component with a high impedance of at least about 500 ohms at the operating frequency of the transponder and a low impedance of at most about 10 ohms at a stop-band frequency of the transponder different than the operating frequency in accordance with both the operating frequency and the stop-band frequency. The method further includes disposing an antenna on a first surface of a dielectric member, conductively coupling a matching circuit to the antenna, conductively coupling an integrated circuit to the matching circuit, conductively coupling the integrated circuit to the antenna, and connecting a notch filter having the determined transmission line length to the matching circuit at a junction between the antenna and the integrated circuit.

The invention also includes an RFID tag having an operating frequency and protected from radar powered voltages at a stop-band frequency different than the operating frequency. The tag includes a dielectric member having a first surface and a second surface opposite the first surface, an antenna disposed on the first surface of the dielectric member, a matching circuit conductively coupled to the antenna, an integrated circuit conductively coupled to both the antenna and to the matching circuit, and a notch filter connected to the matching circuit at a junction between the antenna and the integrated circuit. Again, the notch filter of the preferred embodiments is a shunt component with a high impedance of at least about 500 ohms at the operating frequency of the tag and a low impedance of at most about 10 ohms at the stop-band frequency of the tag different than the operating frequency. The notch filter has a transmission line length determined by both the operating frequency and the stop-band frequency of the tag.

The known limiter diode and the band pass filters have added the cost to the final RFID product, while the notch filter would provides the same or better filtering with no more risk than the limiter or discrete component filters without adding the cost, because the notch filter comes with the printed circuit.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The most common transmission line filters use a ¼ wavelength transmission open or short stub that transforms an open circuit to a short or a short circuit to an open, respectively. The transmission line for this invention strays from conventional approaches by using a transmission line length determined such that the filter impedance is very high at the operating frequency range and very low at the stop frequency range in comparison to the operating impedance. Therefore the pass-band and stop-band frequencies determine the transmission line length rather than conventionally used quarter wavelength transmission lines. For example, the preferred transmission line length for the exemplary notch filter disclosed herein is about 3.4 to 3.5 inches instead of the conventional 1.7 inch ¼ wavelength transmission line length for a 915 MHz signal.

To suppress the 1300 MHz signal, a junction between the antenna and the antenna impedance matching circuit is used to connect the shunt notch filter components. Since the operating impedance of the junction is about 200 ohms, the 915 MHz signal from the antenna will feed the ASIC without any attenuation with a high shunt impedance (e.g., at least 500 ohms) component, while the 1300 MHz signal will be attenuated significantly by a low shunt impedance (e.g., at most 10 ohms) component. It is understood that the reference to a 915 MHz signal throughout this description actually refers to the microwave band from about 902 MHz to 928 MHz.

Figure 1:
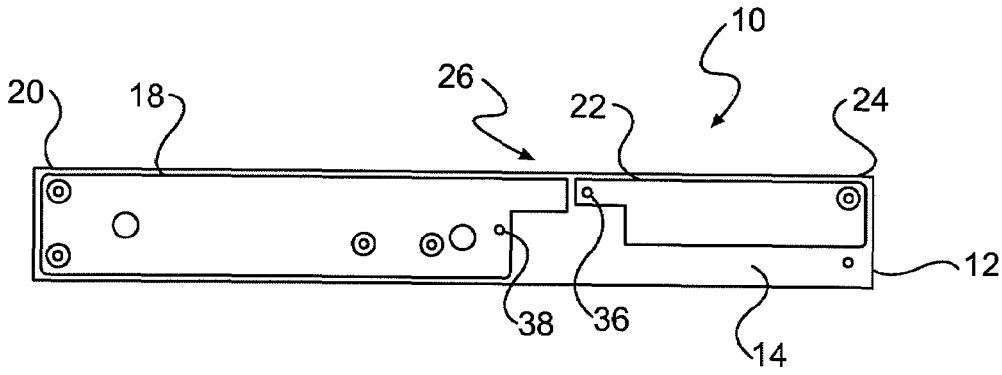
FIG. 1 is a top plan view illustrating the conductive pattern on a first side of a dielectric member included in a transponder assembly of a preferred embodiment.
Figure 2:
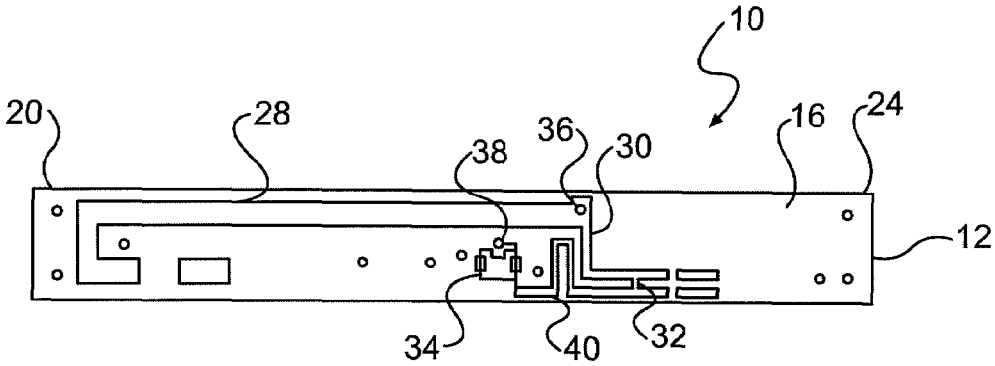
FIG. 2 is a through view illustrating the conductive pattern on the second side of the dielectric member included in the transponder assembly of FIG. 1.

In one embodiment of the invention depicted in FIGS. 1 and 2, a transponder assembly 10 includes a dielectric member 12. The dielectric member 12 is a dielectric substrate preferably made from thin suitable insulating material such as a fiberglass, the thickness being of the order of approximately 1/16". The dielectric member may have a length of about 5.10" and a width of about 0.67", and have a dielectric constant of about 4.5. Preferably the components of the transponder 10 are surface mounted so that the packaged transponder is as thin as possible. The dielectric member 12 includes oppositely disposed parallel surfaces 14 and 16.

Figure 3:
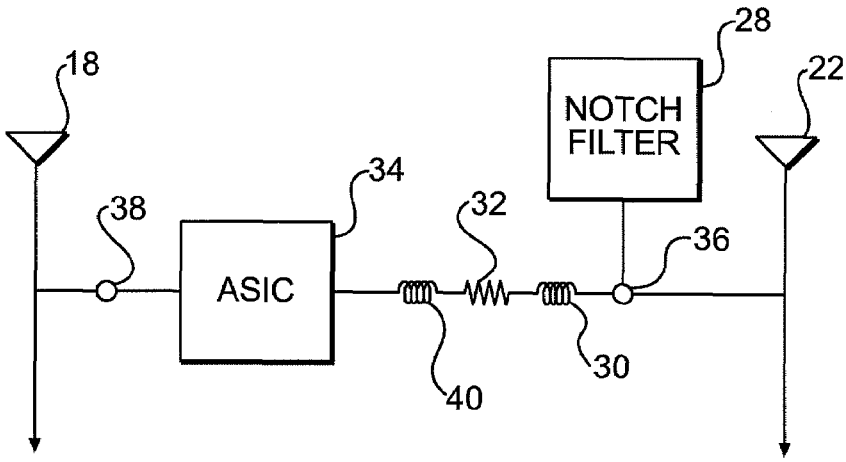
FIG. 3 is a schematic circuit diagram of electrical circuitry associated with the transponder assembly of the preferred embodiments.

As can be seen in FIG. 1, a first conductive member 18 is disposed on the surface 14. The first conductive member 18 is preferably made from a thin sheet of a metal such as copper, silver or conductive ink, and this thin sheet may be covered with a suitable material for soldering such as a nickel solder. While not being limited to a particular theory, the first conductive member 18 covers a substantial portion (e.g., more than half) of the area of the surface 14 at a first end 20 of the dielectric member 12, and is used as a circuit ground for an ASIC as shown in FIG. 3. Similarly, a second conductive member 22 is disposed on the surface 14 at a second end 24 of the dielectric member 12. The second conductive member 22 is preferably formed from layers of copper and nickel in the same manner as the first conductive member 18. While not being limited to a particular theory, the second conductive member 22 is preferably smaller than the first conductive member. However, it is understood that the invention is not limited to the size or composition of the conductive members in relationship to each other or to the dielectric member 12. The conductive members 18 and 22 define opposite ends of a dipole antenna 26 formed on surface 14 of the dielectric member 12. For optimal results, the lengths of each of the poles in the dipoles should be traditionally ¼ of a wavelength at the frequency of operation of the antenna. While not being limited to a particular theory, the dipole antenna 26 is preferably printed onto the dielectric member 12, but may be disposed in known alternative manners.

Referring to FIG. 2, a notch filter 28 is disposed on the surface 16 of the dielectric member 12. The notch filter 28 is "J" shaped for this particular application. While not being limited to a particular theory, the notch filter 28 extends along the surface 16 from the first end 20 opposite the first conductive member 18 to a via hole 36, which meets the second end 24 opposite the second conductive member 22. The notch filter is preferably formed from conductive layers (e.g., copper, nickel, silver, conductive ink) in the same manner as the first and second conductive members 18 and 22.

A transmission line is considered as a sequentially connected plurality of microcircuits, with each microcircuit made of a small series inductor and a shunt capacitor. The notch filter 28 uses the transmission line formed by the "J" shaped inductive conductor in conjunction with the capacitance formed by the "J" shaped inductive conductor and the antenna element 18. In other words, the "J" shaped inductive conductor and first conductive member 18 create the capacitance and inductance that forms the transmission line. Accordingly, the preferred transmission line length is defined by the "J" shaped notch filter.

The notch filter 28, which is connected to the via hole 36, is coupled to an ASIC 34 through a printed inductor 30, a resistor 32 and a printed inductor 40. The resistor 32 is used to modify the sensitivity of the RFID transponder as desired for the requirements of the circuit. In this example, the resistor 32 has an electrical resistance of about 9.09 ohms, although the invention is not limited thereto. The configuration of the transmission line shown in FIG. 2 also creates printed inductor 30 and printed inductor 40 at each side of the resistor 32. The printed inductor 30, resister 32 and printed inductor 40 form the antenna impedance matching circuit.

In this example of the preferred embodiments, the notch filter 28 is connected as a shunt component at the first via hole 36 where the antenna 26 and the matching circuit meet. In particular, the dielectric member 12 includes two via holes for connecting the electrical components disposed on opposite surfaces 14, 16. For example, as can be seen in FIGS. 1 and 2, a first via hole 36 is arraigned through the dielectric member 12 as an aperture between the notch filter 28 and the second conductive member 22 for electrically linking the filter and conductive member with a conductive link there between. Likewise, a second via hole 38 is arraigned through the dielectric member as an aperture between the ASIC 34 and the first conductive member 18 for electrically linking the two components. The conductive links through the dielectric member, and also the matching circuit, are formed by a conductive material, for example copper, nickel, silver, conductive ink, or some combination thereof as used to form the first and second conductive members. The transmission line can be any type including a coaxial cable, a printed circuit transmission line, etc.

FIG. 3 is a schematic circuit diagram of electrical circuitry associated with the transponder assembly shown in FIGS. 1 and 2. FIG. 3 shows the second conductive member 22 of the dipole coupled through the via hole 36 with the notch filter 28, which is connected via the printed inductor 30 to the resistor 32, the printed inductor 40 and the ASIC 34. Further, the ASIC 34 is shown in the circuit diagram coupled through the via hole 38 to the first conductive member 18.

Figure 4:
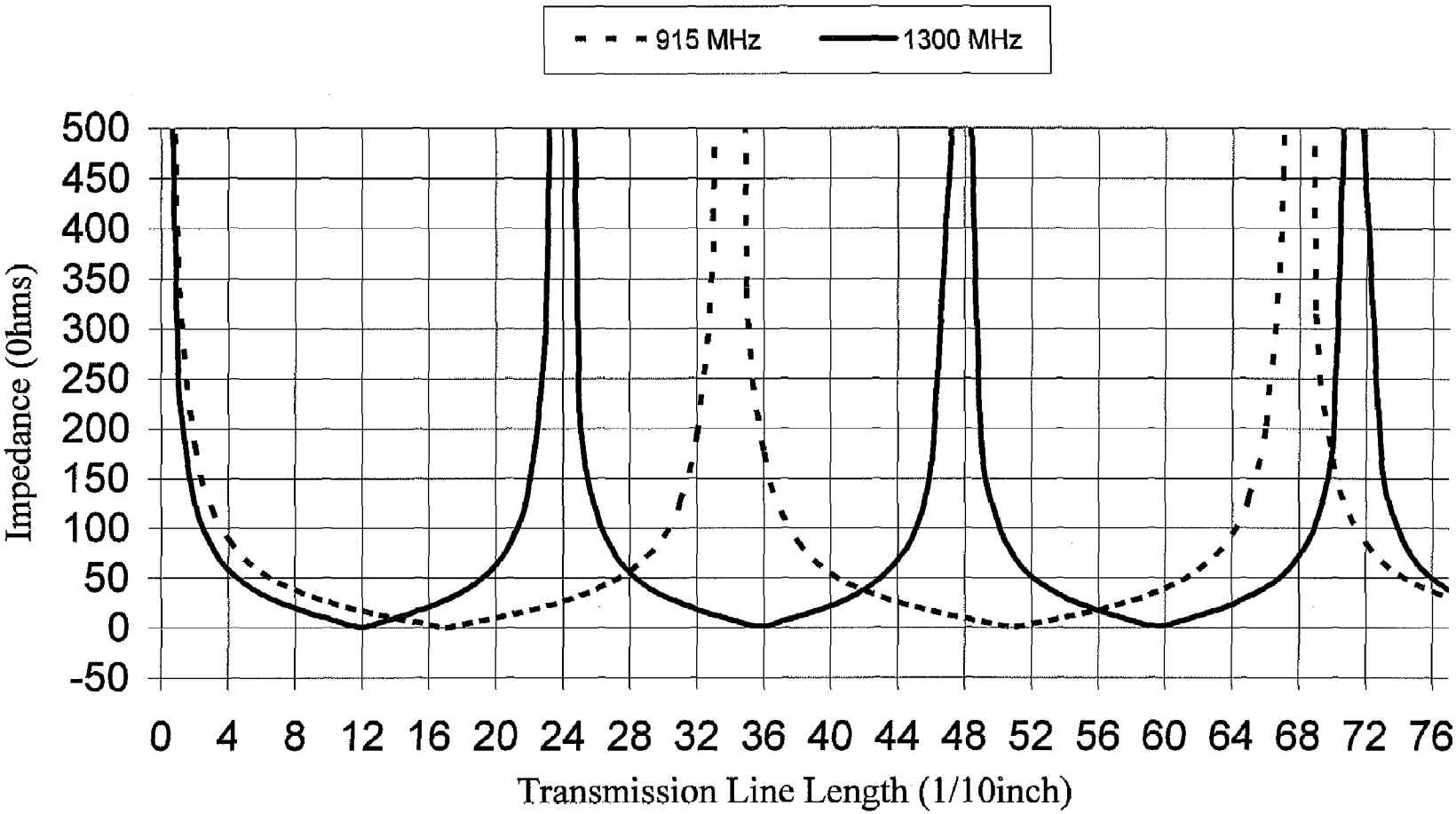
FIG. 4 is a graph illustrating impedance over transmission line length for the exemplary frequencies of the preferred embodiments.

FIG. 4 is a graph illustrating the impedance over transmission line length for the exemplary frequencies of the preferred embodiments. To determine the correct transmission line length, impedances for the frequencies 915 MHz and 1300 MHz are calculated using Applied Wave Research Inc.'s MWOFFICE software simulation for a FR4 pin circuit laminate PCB with a dielectric constant of 4.5. As can be seen in FIG. 4, a transmission line length of 3.4 inches to 3.5 inches provides greater than 500 ohms at 915 MHz and less than 10 ohms at 1300 MHz. These results are unexpectedly better than a transmission line length of a conventional 1.7 inch ¼ wavelength transmission line length for a 915 MHz signal, which would not work to pass the 915 MHz signal from the antenna to the ASIC without substantial attenuation. As can be seen in FIG. 4, using a conventional 1.7 inch ¼ wavelength transmission line length for a 915 MHz signal would shunt the signal with a low shunt impedance component and render the transponder useless for communication at the desired frequency band. Likewise, using a conventional 1.2 inch ¼ wavelength transmission line length for a 1300 MHz signal would shunt the 915 MHz signal with a low shunt impedance component and render the transponder useless for communication at the desired 902 MHz to 928 MHz frequency band.

Figure 5:
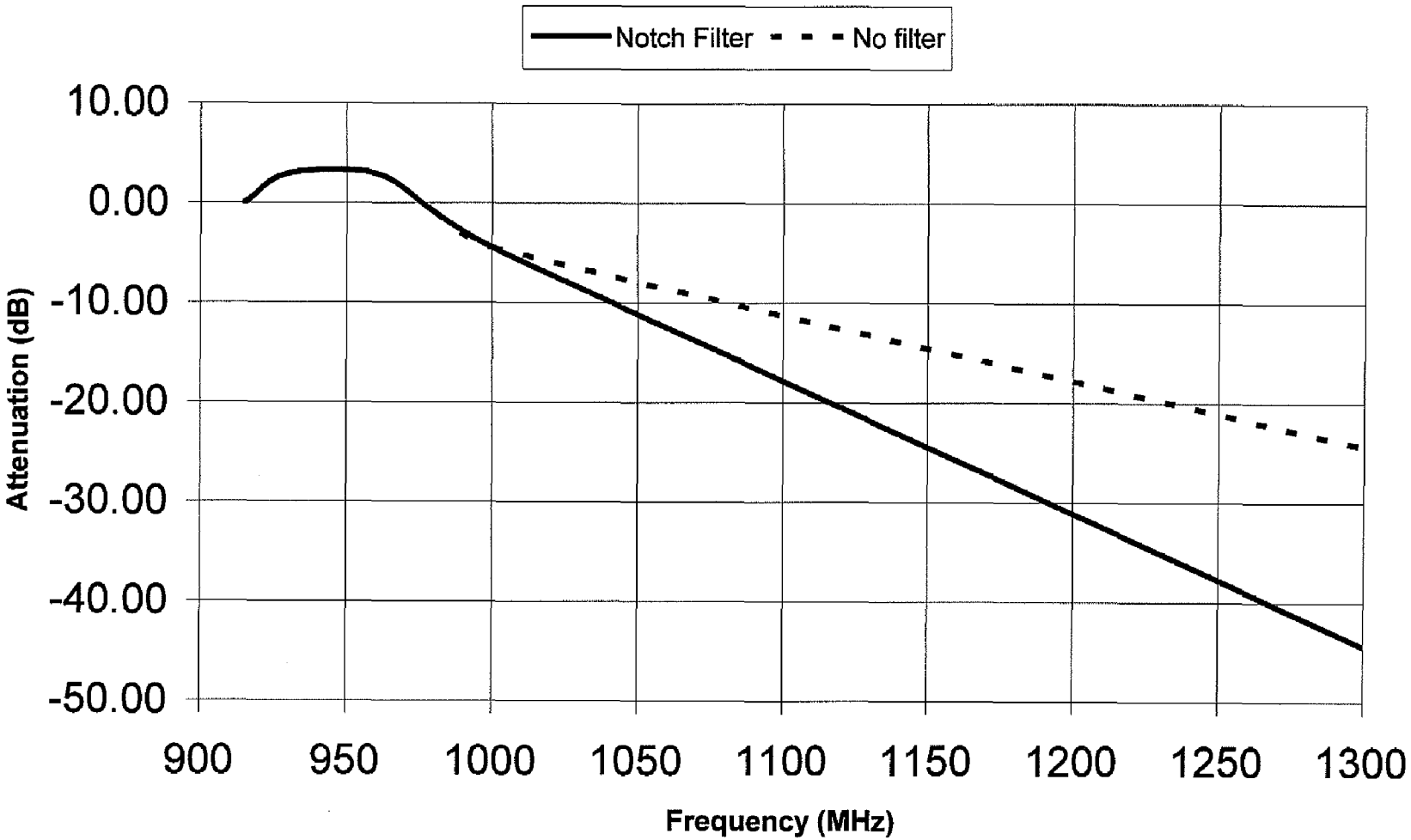
FIG. 5 is a graph illustrating differences in attenuation for a RFID tag with and without the notch filter of the preferred embodiments.

FIG. 5 is a graph illustrating differences in attenuation for a RFID tag with and without the notch filter of the preferred embodiments. As can be seen for simulation results normalized at the operating frequency of 915 MHz, the signal level at 1300 MHz is attenuated by 44 dB for an RFID tag of the preferred embodiments with the notch filter compared by 24 dB at 915 MHz for an RFID tag without the filter.

Figure 6:
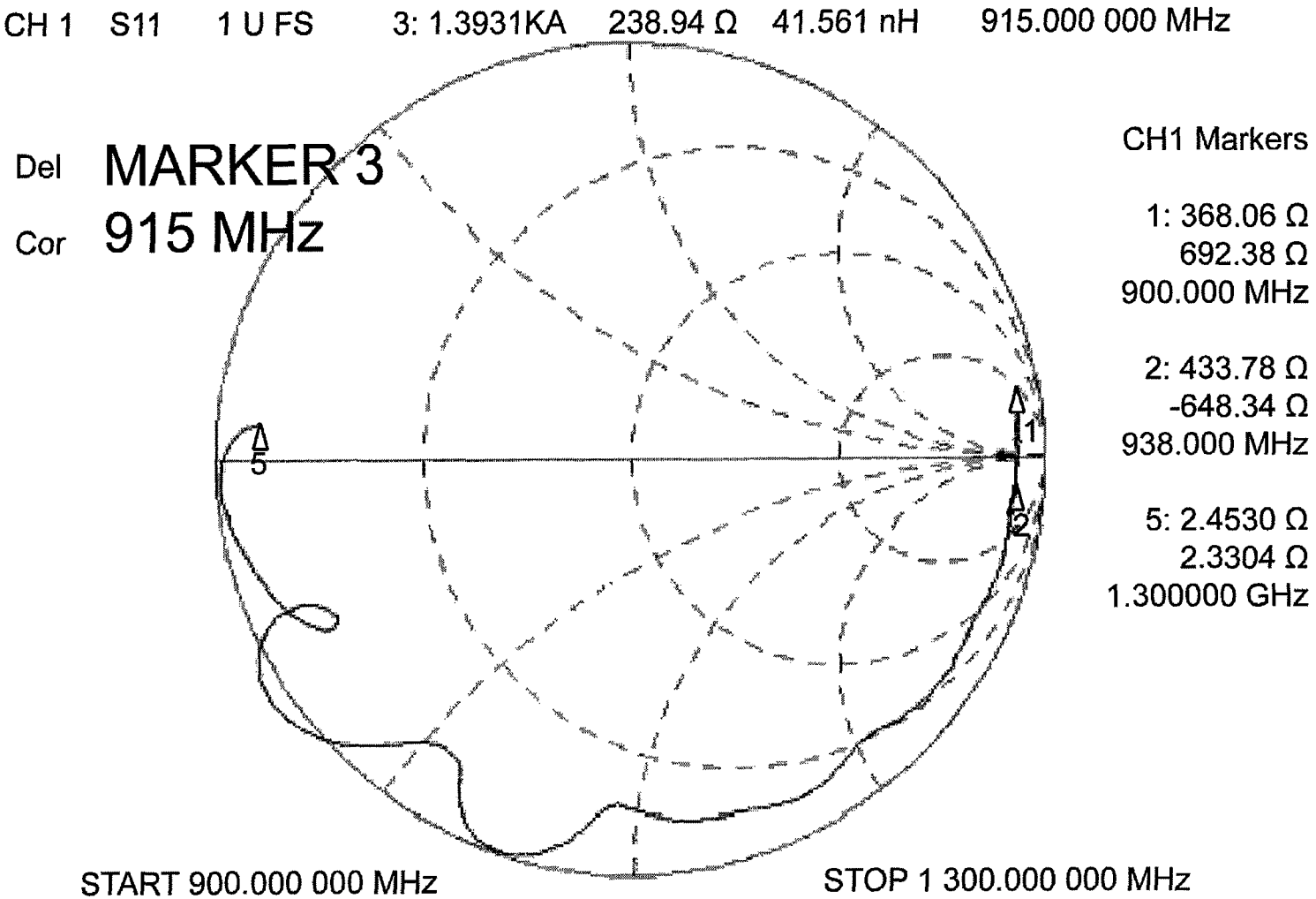
FIG. 6 depicts a network analyzer Smith Chart for the impedance of the preferred transponder with the determined transmission line length.

FIG. 6 shows a network analyzer Smith Chart for the impedance of a RFID tag of the preferred embodiments after adjusting the transmission line to the correct length. The Smith Chart indicates a very high impedance of about 1400 ohms at the preferred operating frequency of 915 MHz and a very low impedance of about 3.4 ohms at the stop frequency of 1300 MHz. Accordingly, a RFID transponder as shown by example of the preferred embodiments operates as desired at microwave frequencies (e.g., 902 MHz to 928 MHz), and is protected by the notch filter from damage from high power microwaves, such as radar, operating at nearby frequencies of about 1300 MHz. In other words, the above discussed circuitry operates like an open circuit at the operating frequency (e.g., 915 MHz) and like a closed circuit at the stop frequency (e.g., 1300 MHz). It is understood that the impedances magnitude at the operating and stop frequencies depends on the operating impedance at the junction where the notch filter is connected.

The preferred transponder is disclosed by example with the notch filter coupled to the ASIC via the matching circuit. It is understood that the preferred embodiments are not limited to this configuration, as for example, the notch filter may be coupled to the matching circuit via the ASIC and remain within the scope of the invention. In other words, the order of conductive connection between the notch filter, the matching circuit and the integrated circuit is not limited to a particular order. Moreover, the placement of the components of the preferred embodiments are not limited to one side (surface) or another side (surface) of the dielectric, as the ASIC, notch filter, antenna and matching filter are also disposed on the dielectric in accordance with manufacturing considerations, such as the limited space of the transponder housing.

While the transponder of the preferred embodiments is directed towards a passive read-write tag for transportation applications, such as the rail industry, the invention is applicable for all types of RFID tags (e.g., passive, semi-passive, active, read only, read-write, reader-talk-first, tag-talk first)

and is well suited for tags operating at radio frequencies, including microwave frequencies (e.g., 902 MHz to 928 MHz) in the U.S.

It is understood that the preferred length of the transmission line varies depending on the operating and stop frequencies. Either an open end or a short end transmission line could be used, with the characteristic impedance of the transmission line varying based on the available space, and the quality factor.

It is understood that the transmission line notch filter described and shown are exemplary indications of preferred embodiments of the invention, and are given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof. For example, in the preferred embodiments, the notch filter is connected as a shunt component between the antenna and the ASIC. Of course, the notch filter is applicable as a shunt component for any electronic circuits. Without further elaboration, the foregoing will so fully illustrate the invention that others may, by applying current or future knowledge; readily adapt the same for use under various conditions of service.

What is claimed is:

1. A transponder having a microwave operating frequency, the transponder comprising:

a dielectric member having a first surface and a second surface opposite the first surface;

an antenna disposed on the first surface of said dielectric member;

a matching circuit conductively coupled to said antenna;

an integrated circuit conductively coupled to both said antenna and to said matching circuit; and a notch filter connected to said matching circuit at a junction between said antenna and said integrated circuit as a shunt component with a high impedance of at least about 500 ohms at the operating frequency of the transponder and a low impedance of at most about 10 ohms at a stop-band frequency of the transponder different than the operating frequency, said notch filter having a transmission line length determined by both the operating frequency and the stop-band frequency of the transponder.

2. The transponder of claim 1, said dielectric member including a first via hole, said matching circuit disposed on the second surface of said dielectric member and conductively coupled to said antenna through the first via hole.

3. The transponder of claim 2, said notch filter disposed on the second surface of said dielectric member.

4. The transponder of claim 2, wherein the junction is the first via hole.

5. The transponder of claim 2, said dielectric member further including a second via hole, said integrated circuit disposed on the second surface of said dielectric member and conductively coupled to said antenna through the second via hole.

6. The transponder of claim 1, said matching circuit including a resistor, a first inductor between said resistor and said notch filter, and a second inductor between said resistor and said integrated circuit.

7. The transponder of claim 1, said antenna including a dipole antenna, said dipole antenna having a first conductive member and a second conductive member, said first conductive member disposed on the first surface of said dielectric member and coupled to said notch filter, said second conductive member coupled to said integrated circuit.

8. The transponder of claim 1, wherein the operating frequency is between about 902 MHz and 928 MHz, the stop-band frequency is about 1300 MHz, and the transmission line length is between about 3.2 inches and 3.6 inches.

9. The transponder of claim 1, wherein said notch filter is connected to said matching circuit at a junction between said antenna and said matching circuit.

10. A method of making a transponder having a microwave operating frequency, the method comprising:

determining a transmission line length for a notch filter to operate as a shunt component with a high impedance of at least about 500 ohms at the operating frequency of the transponder and a low impedance of at most about 10 ohms at a stop-band frequency of the transponder different than the operating frequency in accordance with both the operating frequency and the stop-band frequency;

disposing an antenna on a first surface of a dielectric member;

conductively coupling a matching circuit to the antenna;

conductively coupling an integrated circuit to the matching circuit;

conductively coupling the integrated circuit to the antenna; and connecting a notch filter having the determined transmission line length to the matching circuit at a junction between the antenna and the integrated circuit.

11. The method of claim 10, further comprising disposing the matching circuit on a second surface of the dielectric member opposite the first surface and conductively coupling the matching circuit to the antenna through a first via hole in the dielectric member.

12. The method of claim 11, further comprising disposing the notch filter on the second surface of the dielectric member.

13. The method of claim 11 further comprising disposing the integrated circuit on the second surface of the dielectric member.

14. The method of claim 10, wherein the step of connecting the notch filter having the determined transmission line length to the matching circuit at the junction between the antenna and the integrated circuit includes connecting the notch filter having the transmission line length of between about 3.2 inches and 3.6 inches.

15. The method of claim 10, the antenna being a dipole antenna with first and second conductive members, the step of disposing an antenna on the first surface of the dielectric member further comprising disposing the first conductive member on the first surface of the dielectric member, the method further comprising coupling the first conductive member to the notch filter and coupling the second conductive member to the integrated circuit.

16. An RFID tag having an operating frequency and protected from radar powered voltages at a stop-band frequency different than the operating frequency, the tag comprising:

a dielectric member having a first surface and a second surface opposite the first surface;

an antenna disposed on the first surface of said dielectric member;

a matching circuit conductively coupled to said antenna;

an integrated circuit conductively coupled to both said antenna and to said matching circuit; and a notch filter connected to said matching circuit at a junction between said antenna and said integrated circuit as a shunt component with a high impedance of at least about 500 ohms at the operating frequency of the tag and a low impedance of at most about 10 ohms at the stop-band frequency of the tag different than the operating frequency, said notch filter having a transmission line length determined by both the operating frequency and the stop-band frequency of the tag.

17. The tag of claim 16, said dielectric member including a first via hole, said matching circuit disposed on the second surface of said dielectric member and conductively coupled to said antenna through the first via hole, said notch filter disposed on the second surface of said dielectric member, said integrated circuit disposed on the second surface of said dielectric member.

18. The tag of claim 16, wherein the operating frequency is between about 902 MHz and 928 MHz, the stop-band frequency is about 1300 MHz, and the transmission line length is between about 3.2 inches and 3.6 inches.

19. The tag of claim 16, said matching circuit including a resistor, a first inductor between said resistor and said notch filter, and a second inductor between said resistor and said integrated circuit.

20. The tag of claim 16, said antenna including a dipole antenna, said dipole antenna having first conductive member disposed on the first surface of said dielectric member and coupled to said notch filter, said dipole antenna further having a second conductive member coupled to said integrated circuit.

* * * * *